United States Patent [19]

Nelson et al.

[11] Patent Number: 4,960,121

[45] Date of Patent: Oct. 2, 1990

[54] HALF-FACE MASK ASSEMBLY

[75] Inventors: James E. Nelson, Williamsville, N.Y.; Valentine A. Castro; Noemi Esparza, both of Pasadena, Calif.

[73] Assignee: Figgie International, Inc., Willoughby, Ohio

[21] Appl. No.: 27,567

[22] Filed: Mar. 18, 1987

[51] Int. Cl.[5] ..... A62B 18/08

[52] U.S. Cl. ..... 128/206.24; 128/206.27; 128/207.11

[58] Field of Search ..... 128/201.22, 201.23, 128/201.24, 203.29, 204.18, 205.25, 206.12, 206.21, 206.23, 206.24, 206.27, 206.28, 207.11, 207.17; 24/669, 702

[56] References Cited

U.S. PATENT DOCUMENTS

| | | | |
|---|---|---|---|
| 1,236,079 | 8/1917 | Hentschel | 24/669 |
| 1,975,797 | 4/1931 | Montuori et al. . | |
| 2,097,676 | 11/1937 | Shindel et al. . | |
| 2,104,016 | 1/1938 | Biggs et al. . | |
| 2,239,004 | 4/1941 | Jung | 24/669 |
| 2,254,854 | 9/1941 | O'Connell et al. . | |
| 2,312,630 | 3/1943 | Dauster et al. . | |
| 2,444,417 | 7/1948 | Bierman et al. . | |
| 2,620,794 | 12/1952 | George et al. . | |
| 2,837,090 | 6/1958 | Bloom et al. . | |
| 2,928,387 | 3/1960 | Layne et al. . | |
| 2,931,356 | 4/1960 | Schwarz | 128/206.24 |
| 3,330,274 | 7/1967 | Bennett et al. . | |
| 3,457,564 | 7/1969 | Holloway et al. . | |
| 3,599,635 | 8/1971 | Ansite et al. . | |
| 3,984,191 | 10/1976 | Doty | 24/669 |
| 4,069,516 | 1/1978 | Watkins et al. . | |
| 4,642,859 | 2/1987 | Kaiser | 24/669 |

FOREIGN PATENT DOCUMENTS

| | | | |
|---|---|---|---|
| 717561 | 2/1942 | Fed. Rep. of Germany | 128/206.23 |
| 933607 | 9/1955 | Fed. Rep. of Germany | 128/207.11 |
| 948940 | 9/1956 | Fed. Rep. of Germany | 128/206.23 |
| 1022911 | 1/1958 | Fed. Rep. of Germany | 128/206.23 |
| 1174168 | 7/1964 | Fed. Rep. of Germany | 128/206.24 |
| 114109 | 5/1945 | Sweden | 128/206.23 |
| 872634 | 8/1961 | United Kingdom | 128/205.25 |

OTHER PUBLICATIONS

3M "The Dual Cartridge" Occupational Hazards Jun. 1986 p. 65.

Survivair "The Blue I" Occupational Hazards Jun. 1986 p. 71.

*Primary Examiner*—Max Hindenburg

*Assistant Examiner*—J. P. Lacyk

*Attorney, Agent, or Firm*—Hodgson, Russ, Andrews, Woods & Goodyear

[57] ABSTRACT

An improved half-face mask assembly (10) which can be easily donned and doffed. The assembly includes a hard shell (12), a rubber-like face seal (14), a head harness assembly (16) and two harness anchors and adjusters (18). These parts can be readily assembled or disassembled. Face seals of differing sizes may be assembled to the hard shell. An improved seal is provided between a hard shell (12) and an associated rubber-like face seal (14). A two point head harness suspension system is typically provided althrough an optional neck strap assembly may be utilized with the half-face mask assembly. In addition, a novel one piece harness anchor and adjuster is disclosed.

17 Claims, 4 Drawing Sheets

Fig. 11.
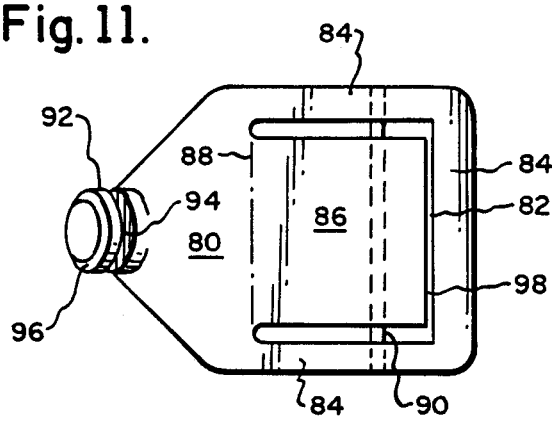
Fig. 13.
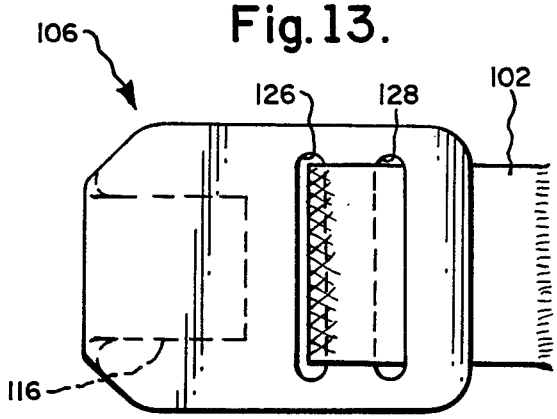
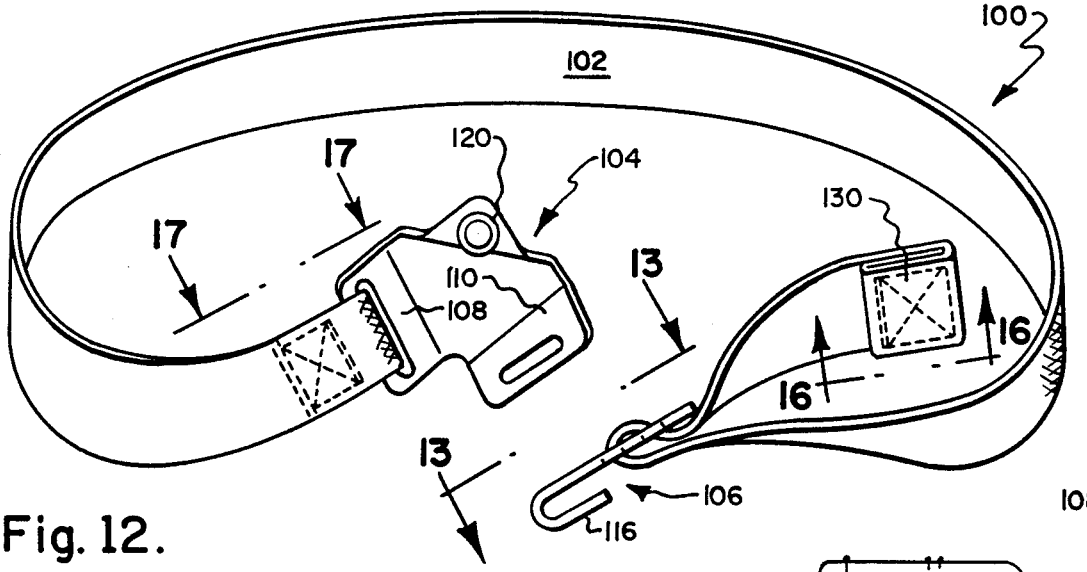
Fig. 12.
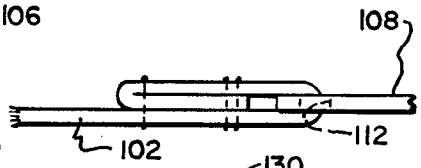
Fig. 17.
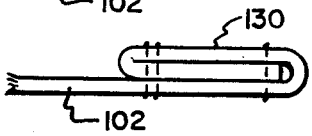
Fig. 16.
Fig. 14.
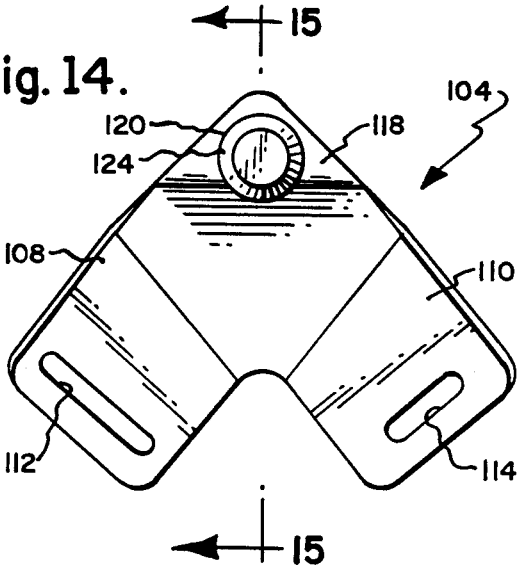
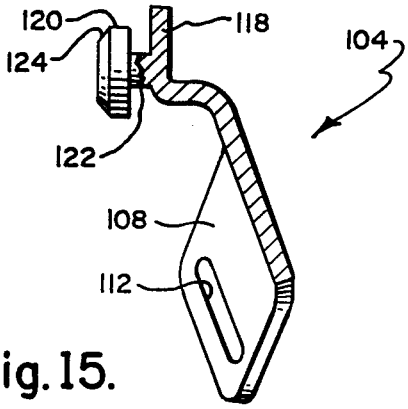
Fig. 15.

HALF-FACE MASK ASSEMBLY

TECHNICAL FIELD

The present invention relates generally to respiration equipment and more particularly to a half-face mask assembly.

BACKGROUND OF THE INVENTION

Half-face masks are well known in the art and representative U.S. Pat. Nos. are 2,444,417; 2,928,387 and 3,330,274. The above patent prior art, as well as other prior art has various limitations which are overcome by the present invention.

OBJECTS OF THE INVENTION

It is an object of the present invention to provide an improved half-face mask assembly which can be readily donned and doffed, which is provided with interchangeable face seals for use on different size faces, which may be readily disassembled for maintenance, and which has numerous improved features over that known in the prior art.

More specifically, one of the objects of the present invention is to provide an improved half-face mask assembly having an hard shell, a rubber-like face seal, and head harness means, wherein differing size rubber-like face seals can be utilized with the hard shell, the hard shell and rubber-like face seals having improved sealing means which will prevent leakage in the seal area between the face seal and the hard shell.

It is a further object of the present invention to provide an improved half-face mask assembly wherein improved mounting means are provided for securing the head harness means to the hard shell and face seal assembly.

It is a further object of the present invention to provide and improved half-face mask assembly which utilizes a novel harness anchor and adjuster.

The above objects and other objects and advantages of this invention will become more apparent after a consideration of the following detailed description taken in conjunction with the accompanying drawings in which a preferred form of this invention is illustrated.

BRIEF DESCRIPTION OF THE DRAWINGS

FIG. 11 is a view of a harness anchor and adjuster taken from an inside position.

FIG. 12 is a view illustrating the optional neck strap assembly.

FIG. 13 is a view taken generally along the line 13—13 in FIG. 12.

FIG. 14 is an enlarged view of the neck strap fastener shown in FIG. 12 prior to the assembly of the neck strap 102.

FIG. 15 is a view taken generally along the line 15—15 in FIG. 14.

FIGS. 16 and 17 are views taken generally along the lines 16—16 and 17—17 in FIG. 12.

DETAILED DESCRIPTION

Figure 7:
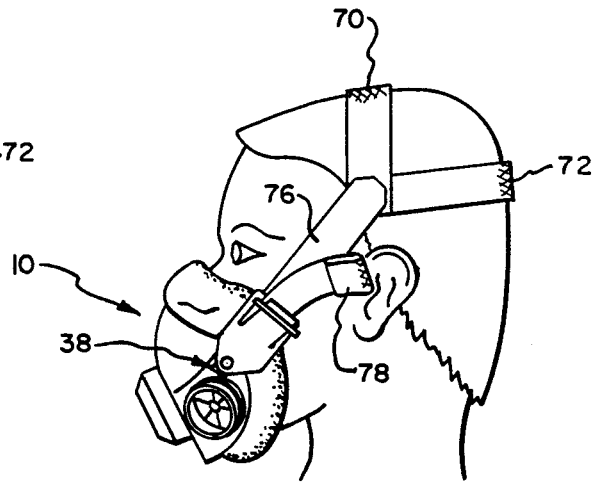
FIG. 7 is a view similar to FIG. 6 but showing the parts in their normal assembled position on the face of the wearer.

In the following description, front and rear reference relates to the location of the parts when assembled together and worn as shown in FIG. 7. The terms inner and outer relate to the disposition of the parts when worn and more specifically as to whether the parts would be within the breathing chamber or outside of the breathing chamber, the breathing chamber being formed between the mask and the face of the user. Other reference terms relate to the position of the parts when worn.

The half-face mask assembly of this invention is indicated generally at 10 and includes four major components, these being a hard shell indicated generally at 12, a face seal indicated generally at 14, a head harness assembly indicated generally at 16, and a pair of harness anchors and adjusters, each of which is indicated generally at 18. When the hard shell and elastomeric face seal are assembled to each other they will be referred to as a hard shell and face seal assembly. Similarly, when the head harness assembly is connected to a pair of harness anchors the assembly will be referred to as head harness means.

Figure 1:
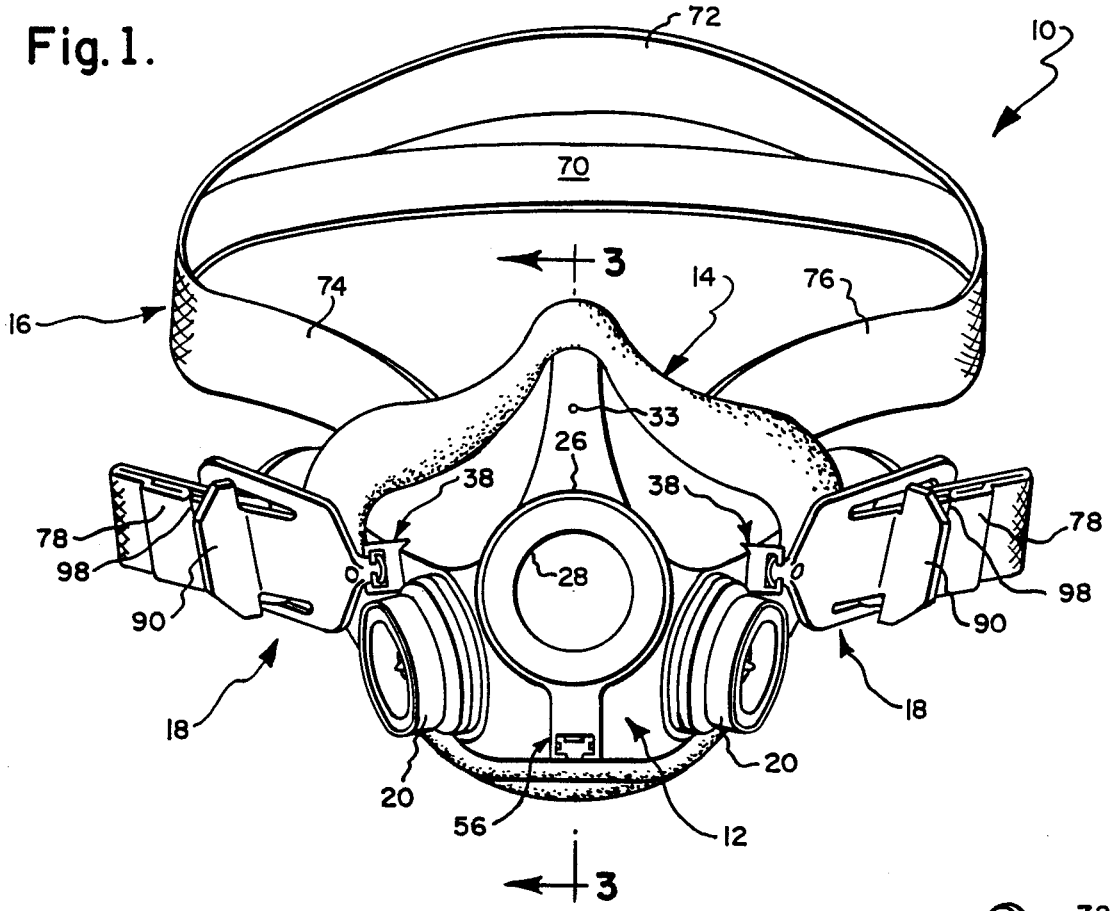
FIG. 1 is a front view of the half-face mask assembly of this invention.
Figure 3:
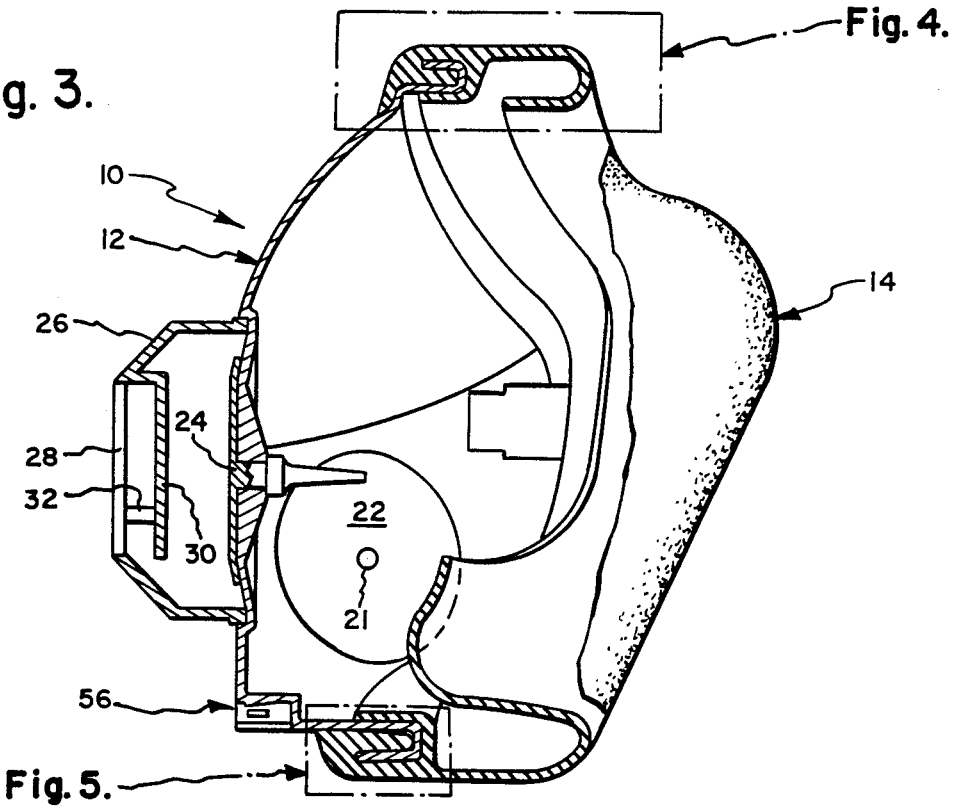
FIG. 3 is a partial sectional view taken generally along the line 3—3 in FIG. 1.
Figure 4:
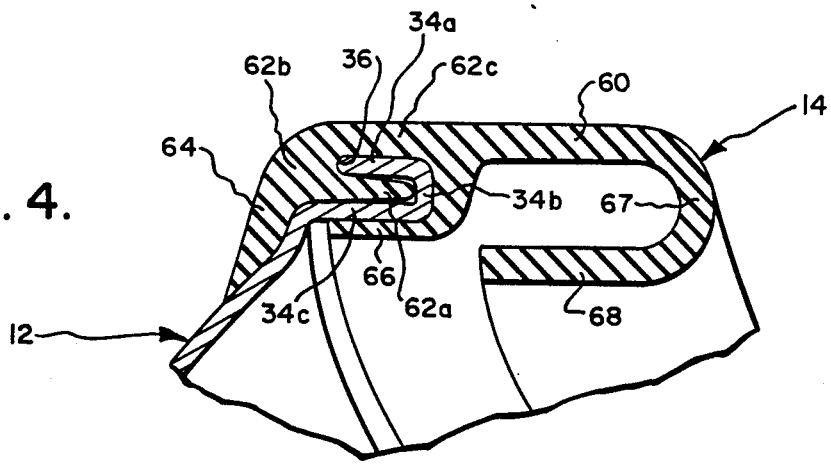
FIGS. 4 and 5 are enlarged sectional views of the portions indicated at FIG. 4 and FIG. 5 in FIG. 3.
Figure 5:
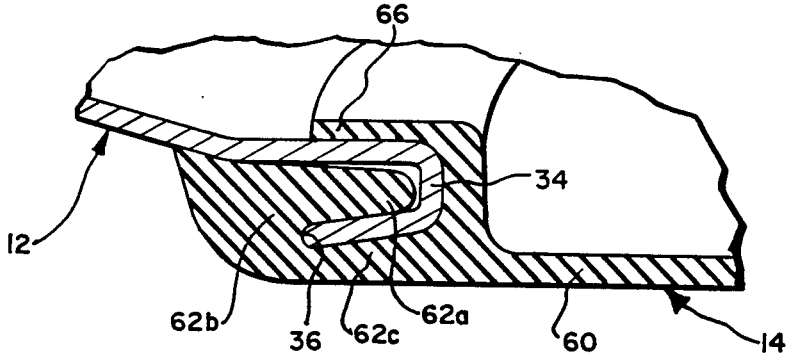

The hard shell is molded from a suitable material such as ABS plastic. When the hard shell is initially molded it is only provided with a single aperture in the front of the mask which is to receive an exhalation valve. However, if either one or two connectors 20 is to be utilized, a hole is punched out for the reception of each connector. In the design shown, each connector is provided with a button 21 (one of which is shown in FIG. 3) which button may receive an inhalation check valve 22. Also, a plurality of triangular shaped apertures are formed in the connector about the location of the button 21. Each connector 20 (which may be provided with external threads for connection to either a source of respirable gas or a suitable filter assembly) may be joined to the hard shell in any manner, but they are preferably secured by ultrasonic welding. Connectors of shapes different than those illustrated in FIG. 1 may be utilized with the hard shell. In the event that two connectors are initially provided, as would be the case when the hard shell is designed for use with two filter assemblies, and it is desired to use the face mask with either a single filter assembly or a source of respirable gas, one of the connectors will be closed off and the other connector will be suitably interconnected with either the single filter assembly or the source of respirable gas. The purpose of the check valve 22 is to prevent the expiration of gases back through a sorbent. The hard shell is also provided with an exhalation valve 24 which is covered by an exhalation valve guard 26. The exhalation opening 28 in the valve guard is so sized that it can be covered by the palm of a wearer to effect a positive pressure test by sealing the opening 28 with the palm of the hand and exhaling. The exhalation guard valve is additionally provided with a protective disk 30 which is held in place by three or more spaced apart legs 32. The hard shell is also provided with a witness mark 33 for locating a probe of the type used for quantitative fit testing.

Figure 8:
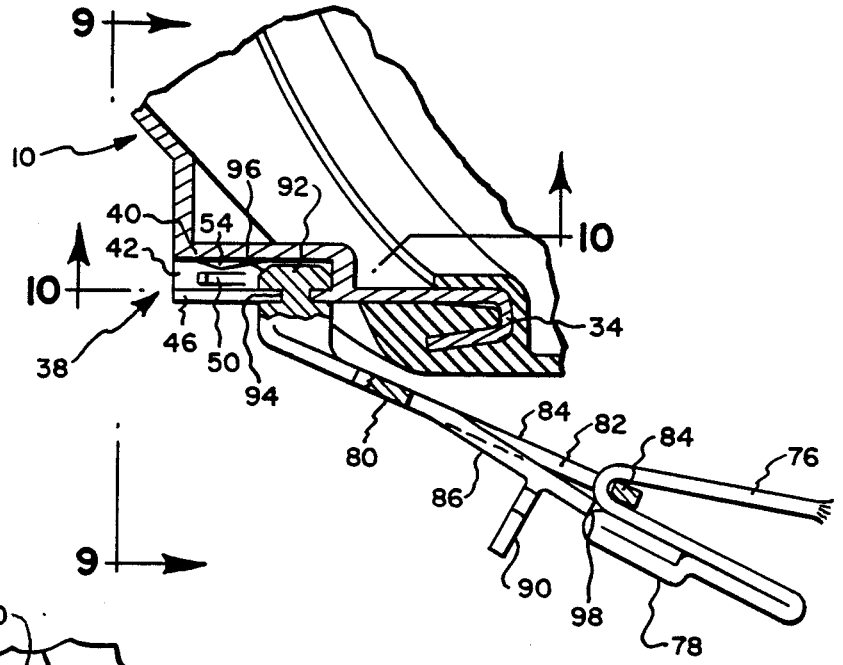
FIG. 8 is a section taken generally along the 8—8 in FIG. 2.
Figure 9:
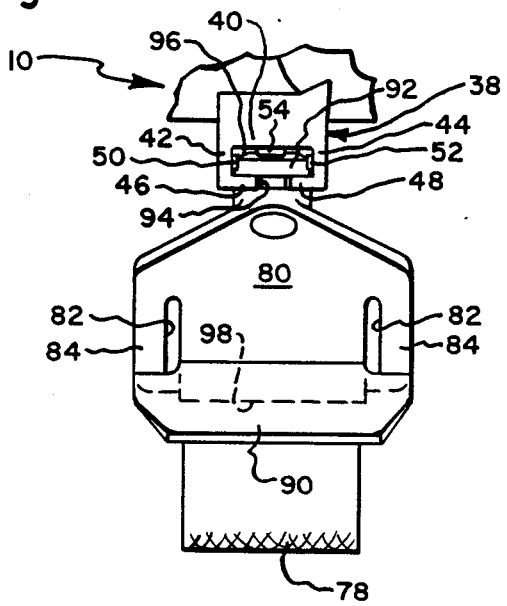
FIGS. 9 and 10 are views taken generally along the lines 9—9 and 10—10 in FIG. 8.
Figure 10:
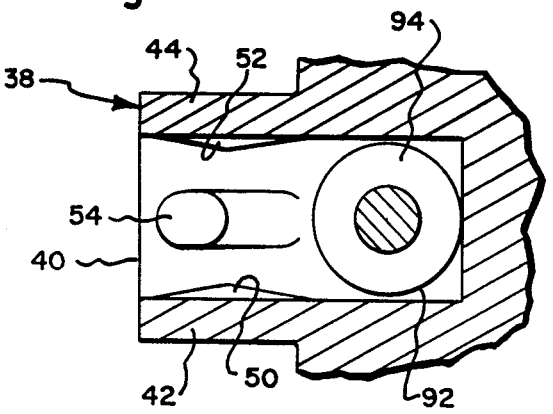

The periphery of the hard shell 12 is provided with a U-shaped peripheral edge 34 framed of a rearwardly disposed bight portion **34*b*, and inner and outer legs 34*c* and 34*a*, respectively, the channel formed by the U-shaped edge being open to the forward side. The free edge 36 of leg 34*a* of the U-shaped edge is disposed to the exterior of the hard shell and forward of the bight portion 34*b*. The hard shell is in addition provided with a pair of laterally spaced apart mounting sockets indicated generally at 38. The mounting sockets are best illustrated in FIGS. 8–10 and include a generally fore-and-aft extending C-shaped structure which includes a base portion 40, a pair of spaced apart sides 42, 44, and inturned spaced apart end portions 46, 48, there being a slot disposed between the end portions as well as between the sides 42, 44, which slot extends in a generally fore-and-aft direction. The sides 42, 44 are provided with ramps 50, 52, respectively. In addition, the base portion is provided with an outwardly extending detent 54, the purposes of the ramps and detent being explained below. The hard shell may additionally be provided with a further mounting socket 56 at the base of the hard shell below the exhalation valve opening, the purpose of the mounting socket 56** being to receive an optional neck strap assembly.

The face seal 14 is a molded annular one piece construction having a central generally fore-and-aft extending central portion 60, a forward hard shell mounting edge which includes a U-shaped peripheral edge portion 62 formed of a forward bight portion **62*b*, and inner and outer legs 62*a*, 62*c*, respectively, the leg 62*c* being an extension of the central portion 60. The bight portion 62*b* may be provided with a forwardly extending lip 64 which is adapted to contact an exterior surface of the hard shell forward of the U-shaped edge 34 of the hard shell. The channel formed by the U-shaped edge is open to the rear side. In addition, the face seal includes a skirt portion 66 which extends inwardly from an intermediate portion of the fore-and-aft extending central portion 60 and then forwardly, the skirt portion 66 being adapted to lie against the leg 34*c* of the U-shaped edge of the hard shell. Finally, the face seal 14 is provided with an inner forwardly extending face contacting portion 68 which is joined at its rear end to the rear end of the fore-and-aft extending central portion 60 by a curved portion 67**. The face seal may be of differing sizes such as for example small, medium, and large to fit faces of differing sizes. Thus, the face contacting portion of a small face seal will be smaller than the face contacting portion of a large face seal. However, the dimensions of the forward hard shell mounting edge will be essentially the same for all sizes of face seals.

By providing different sizes of face seals and a single size of hard shell, it should be observed that the half-face mask of this invention can be utilized by most users of differing size faces. Thus, if a user having a relatively small face is to use the half-face mask of this invention, a small face seal is assembled to the hard shell. Similarly, if an a user having a relatively large face is to use this invention, a large face seal is assembled to the hard shell. The assembly can be accomplished without the use of special tools or adhesives, which will facilitate the disassembly for cleaning and maintenance purposes.

The interlocking U-shaped portions 34 and 62 provide an effective sealing area and the sealing is further improved by utilization of the skirt portion 66 which is found to be especially effective when used in positive pressure applications. The lip 64 also increases the sealing area thus minimizing the likelihood of gases passing between the U-shaped portions during inhalation. The elongated fore-and-aft central portion and curved portion 67 serves as a cushion when the half-face mask is held onto the face of the wearer by the head harness assembly and the harness anchors and adjusters thus virtually eliminating any pressure points.

Figure 2:
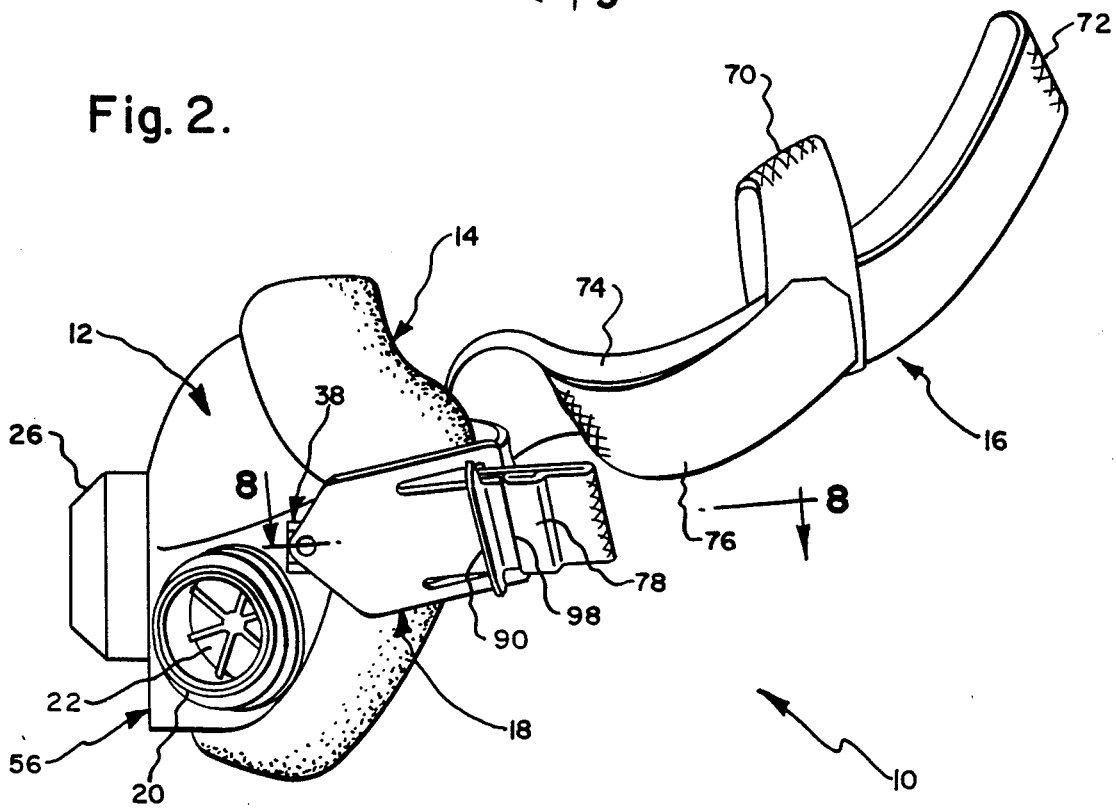
FIG. 2 is a side view of the assembly shown in FIG. 1.
Figure 6:
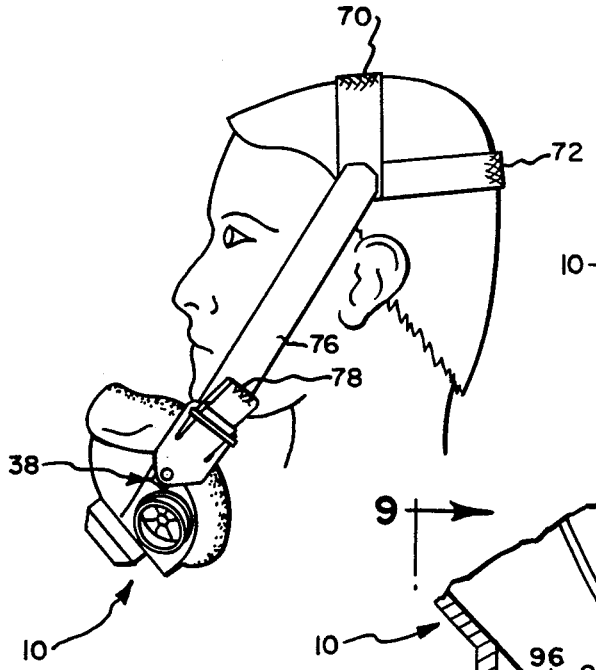
FIG. 6 is a view illustrating the half-face mask assembly of this invention partially mounted onto a wearer's head.

The head harness assembly consists essentially of four straps, these being a top head strap 70, a back head strap 72 and laterally spaced apart right and left adjusting straps 74, 76, respectively. All of the straps are made of a relatively stiff, although flexible material, which will resist twisting and tangling. The ends of the top and back straps 70, 72, respectively are sewn together at approximately right angles to each other, and the upper rear ends of the right and left adjusting straps are joined to the junction of the top and back straps, the straps 74, 76 extending downwardly and forwardly away from the top and back straps 70, 72 as best illustrated in FIGS. 6 and 7. The free end of each of the adjusting straps 74 and 76 is folded back as can best be seen from FIGS. 2 and 8 to provide a strap tab 78.

The half-face mask further includes a pair of harness anchors and adjusters 18, and these head harness adjusters, in conjunction with the head harness assembly 16, are capable of holding the hard shell and face seal assembly onto the face of the wearer as can be seen from FIG. 7. Each of the pair of harness anchors and adjusters 18 include a relatively thin planar portion 80 formed of a relatively rigid but resilient material such as nylon or the like. The portion 80 is provided with a generally rectangular U-shaped slot 82 which extends through the material to define a U-shaped border portion 84 and a relatively movable generally rectangular portion 86 which is joined to the generally planar portion along one side only, which side is indicated by the dot-dash line 88 in FIG. 11.

A manually engageable tab 90 is secured to the outer side of the rectangular portion 86. Disposed on the forward inner side of the relative thin planar portion 80 is mounting means in the form of a stud 92 provided with an annular groove 94, the end of the stud being provided with an annular ramp 96. The tab 90 and mounting means 92, 94 are preferably molded integrally with the planar portion 80, these parts also being made of the same material.

The manner in which the various parts are assembled should be apparent from the drawings. However, it should be noted that a suitably sized face seal is selected for assembly to the hard shell, the size of the face seal being dependent upon the size of the wearer's face. Once the face seal is selected, it is merely assembled onto the hard shell by inserting the free end of the U-shaped seal 60 between the legs and adjacent the bight of the U-shaped channel 34 on the hard shell until the entire peripheral seal 62 of the face seal is properly located upon the hard shell. Next, the tabs 78, which are formed on the free ends of the spaced apart straps 72 are passed through the bight portion of the U slot 82 from an inside position to an outside position, as can best be seen from FIG. 8. Once both harness anchors and adjusters have been assembled onto the free ends of the laterally spaced apart straps 74, 76 of the head harness assembly 16, it is then only necessary to assemble the harness anchors 18 to the hard shell. This is done merely by inserting the stud 92 into an associated slot in one of the laterally spaced apart mounting sockets 38, the stud of the harness anchor associated with the left hand adjusting strap being received within the slot of the left hand mounting socket 38, and the stud on the harness anchor associated with the right hand adjusting strap being received within the mounting socket on the right side of the hard shell. Once the studs are moved to a full rearward position within the slot, as shown in FIG. 8, they will be held within that position against inadvertent removal by detent 54 and ramps 50, 52. However, if it is desirable to remove a harness anchor from a mounting structure, such a removal is possible as the sides 42, 44 can spread apart during the removal of the grooved stud 92, 94 and also, because the end portions 46 and 48 can shift away from the base 40 as the end of the stud passes over the detent 54.

Once the half-face mask has been fully assembled, it is only necessary to place the top head strap 70 on the top of the head of the wearer and the back strap 72 across the back of the head as illustrated in FIG. 6. After this has been done, it is only necessary to grasp the strap tabs 78 and pull them in an upward and rearward direction until the half-face mask is assembled onto the face of the wearer. The natural resiliency of the U-shaped border 84 and rectangular portion 86 will cause the free side 98 of the rectangular portion 86 to move towards the bight of the U-shaped border 84 pinching the strap therebetween and maintaining the parts in their assembled position as shown in FIG. 7. If the wearer wishes to partially remove the half-face mask file while retaining the head harness assembly 16 in place, as may desirable when wearing a hard hat when re-use is anticipated, it is only necessary to engage the tab 90 with thumb and forefingers and simultaneously pull the tabs outwardly and in a direction away from the ears so that the mask can resume the position illustrated in FIG. 6. The tabs 78 will act as stops when they contact side 98 as shown in FIG. 8. The straps 74, 76 are of such length that the mask can easily be worn in this position.

As previously indicated, the half-face mask assembly of this invention may be utilized with an optional neck strap assembly, which is indicated generally at 100 in FIG. 12. The neck strap assembly includes an elastic strap 102, a neck strap fastener indicated generally at 104, and a hook indicated generally at 106. The neck strap fastener, as viewed in FIG. 14, is generally V-shaped having spaced apart legs 108, 110. The leg 108 is provided with a transverse slot 112 adjacent one end and one end of the elastic strap 102 is passed through the slot and is reversely folded back upon itself and sewn together as can be seen from FIGS. 12 and 17. The other leg 110 is also provided with a transverse slot 114, which slot is capable of receiving the end 116 of the hook 106. The apex 118 of the neck strap fastener is offset from the legs (as can be seen from FIG. 15) and is provided with a button 120 which is integral with a coaxial shank 122 of reduced diameter, the shank 122 also being integral with the apex. The button is provided with an annular ramp surface 124. It can be seen that the button and shank correspond generally to the grooved stud 92, 94 and may be received within the mounting socket 56 in the same manner as the harness anchors and adjusters are received within their associated sockets 38. Thus, the mounting socket 56 is also provided with ramps 50, 52 and detent 54. The end of the elastic strap 102, which is opposite the end that is secured to the neck strap fastener 104, is passed through a pair of spaced apart transverse slots 126, 128 in hook 106 as can best be seen from FIGS. 12 and 13. After the end of the strap 102 has been passed through the slots 126, 128, it is folded back upon itself and is sewn together as can best be seen from FIGS. 12 and 16 to form a tab 130.

While the two point suspension shown in FIGS. 6 and 7 will provide adequate retention, some wearers or users may additionally want the neck strap assembly 100. Therefore, it is only necessary to slide the button 120 into the mounting socket 56 until it is in its full rear position. When the mask is then mounted onto the face as shown in FIG. 7, it is only additionally necessary to pass the strap 102 behind the neck of the wearer, to place the hook 116 in slot 114, and pull on the tab 130 until the neck strap assembly is comfortably tight.

The half-face mask described has a number of advantages over those commonly available in the marketplace today. Thus, by providing one size hard shell and head harness means, and only different sizes of face seals 14, it is possible to accommodate most wearers with the half-face mask of this invention. By utilizing the two point suspension system, it is possible to quickly donn and doff, either partially or fully, the half-face mask of this invention. The non-elastic head harness, which is made of a relatively stiff fabric like material, easily resists tangling so that it is not necessary to untangle a harness prior to application. The hard shell permits better voice communications than is available with half-face masks made of a rubber-like material. Also, the parts can be readily disassembled, without the use of tools, for routine maintenance, etc.

While a preferred structure in which the principles of the present invention have been incorporated is shown and described above, it is to be understood that widely differing means may be employed in the broader aspects of this invention. Accordingly, this invention is intended to embrace all such alternatives, modifications and variations which fall within the spirit and scope of the apended claims.

What is claimed is:

1. A half-face mask comprising:

a hard shell provided with a U-shaped peripheral edge portion having spaced apart inner and outer legs and a bight portion which defines a channel open to the forward side;

an elastomeric face seal removably secured to said hard shell, the face seal including a U-shaped peripheral edge, a skirt, and face contacting portion, the U-shaped peripheral edge having inner and outer legs and a bight portion which defines a channel open to the rear side, the U-shaped peripheral edge of the face seal being secured to the U-shaped peripheral edge of portion of the hard shell in interlocking relationship, the inner leg of the U-shaped peripheral edge of the face seal being received between the inner and the outer legs of the U-shaped peripheral edge portion of the hard shell, and the skirt having a portion parallel to said U-shaped peripheral edge of the face seal and lying against a back portion of the U-shaped peripheral edge portion of the hard shell, the skirt extending from the face seal around the back of the bight portion and the inner leg of the U-shaped peripheral edge portion, the skirt being in contact with the inner leg of the U-shaped peripheral edge portion of the hard shell; and head harness means secured to the hard shell for holding the hard shell and face seal onto the face of a wearer.

2. The half-face mask assembly as set forth in claim 1 wherein the elastomeric face seal further includes a fore-and-aft central portion between the U-shaped peripheral edge and the face contacting portion, said fore-and-aft central portion acting as a cushion when the hard shell and elastomeric face seal are held onto the face of a wearer.

3. The half-face mask assembly as set forth in claim 1 wherein the elastomeric face seal further includes a lip which is in contact with an exterior surface of the hard shell forward of the U-shaped edge of the hard shell, the lip being integral with the bight portion of the U-shaped peripheral edge of the elastomeric seal and extending forwardly and inwardly therefrom.

4. The half-face mask assembly as set forth in claim 1 wherein the hard shell is further provided with a pair of laterally spaced apart integral mounting sockets, each of which is provided with a generally fore-and-aft extending slot open at its forward end, and wherein the head harness means includes a head harness assembly disposable about the head of a wearer, the head harness assembly including a pair of laterally spaced apart straps, and a pair of harness anchors and adjusters, each of which receives an end of one of the pair of laterally spaced apart straps, and each of said harness anchors further including a grooved stud engaging one of said laterally spaced apart mounting slots.

5. The half-face mask assembly as set forth in claim 1 wherein the head harness means includes a pair of laterally spaced apart straps, and further includes a pair of harness anchors and adjusters secured to laterally spaced apart portions of the hard shell, each of said pair of harness anchors and adjusters receiving an end of one of said laterally spaced apart straps, and each of said pair of harness adjusters including a relatively thin planar portion of a hard resilient material such as nylon or the like, there being a generally rectangular U-shaped slot including a bight portion extending through the material to define a U-shaped border portion and a relatively movable generally rectangular central portion joined to the generally planar portion along one side only, the end of one of the laterally spaced straps passing through the bight portion of the U-shaped slot to cause the movable central portion to be resiliently shifted a slight amount out of the plane of the border portion, a manually engageable tab secured to one side of the movable central portion, which tab is capable of being engaged to pull the movable central portion further out of the plane of the border portion to permit free movement of the associated strap in either direction, and mounting means on the end of the generally planar portion remote from the bight portion of the U-shaped slot, which mounting means secures the associated harness anchor and adjuster to one of said laterally spaced apart portions of the hard shell.

6. The half-face mask assembly as set forth in claim 1 wherein the inner leg of the U-shaped peripheral edge of the face seal is wedge shaped.

7. A half-face mask comprising:

a hard shell formed of a hard resilient material, the shell being provided with a pair of integral laterally spaced apart mounting sockets, each of which is provided with a generally fore-and-aft extending slot open at its forward end, each slot being defined by a base portion, a pair of spaced apart sides which extend outwardly from the base portion at approximately right angles, and pair of inturned spaced apart end portions;

an elastomeric face seal removably secured to the periphery of said hard shell; and head harness means secured to said hard shell for holding the hard shell and face seal assembly onto the face of a wearer, said head harness means including a head harness assembly disposable about the head of a wearer, the head harness assembly including a pair of laterally spaced apart straps, and a pair of harness anchors and adjusters, each of which receives an end of one of the pair of laterally spaced apart straps, and each of said harness anchors further including a grooved stud engaging one of said laterally spaced apart mounting slots, the diameter of the stud being just slightly less than the diameter of the associated slot.

8. The half-face mask assembly as set forth in claim 7 wherein the distance between the end portions and the base portion of the slot is just slightly greater than the length the stud between the end of the stud and the groove, wherein the base portion is provided with a detent capable of engaging the stud to resist its withdrawal after it has been fully inserted into the slot, and wherein the forward end of the slot is provided with an ramp surface.

9. The half-face mask assembly as set forth in claim 7 wherein each side of each slot is provided with a ramp which extends towards the other side, the distance between the high point of opposed ramps being less than the diameter of the stud.

10. The half-face mask assembly as set forth in claim 8 wherein each side is provided with a ramp which extend towards the other side, the distance between the high point of opposed ramps being less than the diameter of the stud.

11. The half-face mask assembly as set forth in claim 7 wherein the hard shell is additionally provided with a lower centrally located third integral mounting socket, and further characterized by a neck strap assembly interconnected with the third mounting socket.

12. The half-face mask assembly as set forth in claim 11 wherein the third mounting socket is provided with a fore-and-aft extending slot open at its forward end, and the neck strap assembly includes a neck strap fastener provided with a button removably received within the slot in the third mounting socket.

13. The half-face mask assembly as set forth in 7 wherein each of the pair of harness anchors and adjusters includes a relatively thin planar portion of a hard resilient material such as nylon or the like, there being a generally rectangular U-shaped slot having a bight portion extending through the material to define a U-shaped border portion and a relatively movable generally rectangular central portion joined to the generally planar portion along one side only, an end of one of the laterally spaced straps passing through the bight portion of the U-shaped slot to cause the movable central portion to be resiliently shifted a slight amount out of the plane of the border portion, a manually engageable tab secured to one side of the movable central portion, which tab is capable of being engaged to pull the movable central portion further out of the plane of the border portion to permit free movement of the associated strap in either direction, and wherein the mounting stud is disposed on the end of the generally planar portion remote from the U-shaped slot.

14. A half-face mask comprising:

a hard shell provided with a pair of integral laterally spaced apart mounting portions;

an elastomeric face seal removably secured to the periphery of said hard shell;

a head harness assembly including a pair of laterally spaced apart straps; and a pair of harness anchors and adjusters secured to the laterally spaced apart mounting portions of the hard shell, each of said pair of harness anchors and adjusters receiving an end of one of said laterally spaced apart straps, each of said pair of harness anchors and adjusters including a relatively thin one piece molded planar portion of a hard resilient material such as nylon or the like, there being a generally rectangular U-shaped slot having a bight portion extending through the planar portion to define a U-shaped border portion and a relatively movable generally rectangular central portion joined to the generally planar portion along the one side only, the end of one of the laterally spaced apart straps passing through the bight portion of the U-shaped slot to cause the movable central portion to be resiliently shifted a slight amount out of the plane of the border portion, a manually engageable tab secured to one side of the movable central portion, which tab is capable of being engaged to pull the movable central portion further out of the plane of the border portion to permit free movement of the associated strap in either direction, and mounting means on the end of the generally planar portion remote from the bight portion of the U-shaped slot for securing the associated harness anchor and adjuster to one of said laterally spaced apart mounting portions of the hardshell.

15. The half-face mask assembly as set forth in claim 14 wherein the width of the bight portion of the U-shaped slot is just slightly greater than the width of a laterally spaced apart strap.

16. The half-face mask assembly as set forth in claim 14 wherein the mounting means is on the side of the relatively thin planar portion which is opposite to said one side to which the manually engageable tab is secured.

17. A harness anchor and adjuster for use with a head harness assembly and a hard shell and face seal assembly; said harness anchor and adjuster comprising:

a relatively thin planar portion of hard resilient material such as nylon or the like, there being a generally rectangular U-shaped slot extending through the material to define a border portion and a relatively movable generally rectangular central portion joined to the border portion along one side only, the U-shaped slot having a bight portion;

a manually engageable tab secured to one side of the movable central portion, which tab is capable of being manually engaged to pull the movable central portion out of the plane of the border portion; and a mounting stud on one end of the border portion remote from the bight portion of the U-shaped slot.

* * * * *